US005581264A

United States Patent [19]

Tabata et al.

[11] Patent Number: 5,581,264

[45] Date of Patent: Dec. 3, 1996

[54] DIVERSITY GLASS ANTENNA FOR AN AUTOMOBILE

[75] Inventors: Kouji Tabata; Kenichi Ishii; Tsuyoshi Yamamoto, all of Aichi-ken, Japan

[73] Assignee: Asahi Glass Company Ltd., Tokyo, Japan

[21] Appl. No.: 361,462

[22] Filed: Dec. 21, 1994

Related U.S. Application Data

[63] Continuation of Ser. No. 38,258, Mar. 24, 1993, abandoned.

[30] Foreign Application Priority Data

Mar. 27, 1992 [JP] Japan ..... 4-101618

[51] Int. Cl.[6] ..... H01Q 1/32

[52] U.S. Cl. ..... 343/713; 343/725; 343/727; 343/704

[58] Field of Search ..... 343/704, 713, 343/793, 794, 725, 726, 727; 455/277.1; H01Q 1/32

[56] References Cited

U.S. PATENT DOCUMENTS

| | | | |
|---|---|---|---|
| 3,771,159 | 11/1973 | Kawaguchi et al. | 343/713 |
| 3,845,489 | 10/1974 | Sauer et al. | 343/713 |
| 3,964,068 | 6/1976 | Torii et al. | 343/704 |
| 4,063,247 | 12/1977 | Sakurai et al. . | |
| 4,331,961 | 5/1982 | Davis | 343/704 |
| 4,864,316 | 9/1989 | Kaoru et al. | 343/704 |
| 5,056,153 | 10/1991 | Taniguchi et al. . | |
| 5,072,229 | 12/1991 | Hirasa . | |
| 5,083,134 | 1/1992 | Saitou et al. | 343/713 |
| 5,165,057 | 4/1992 | Sharples | 343/713 |
| 5,231,410 | 7/1993 | Murakami et al. | 343/713 |
| 5,274,388 | 12/1993 | Ishizaki et al. | 343/725 |

FOREIGN PATENT DOCUMENTS

| | | | |
|---|---|---|---|
| 0960759 | 1/1975 | Canada | 343/713 |
| 0325510 | 7/1989 | European Pat. Off. . | |
| 0326651 | 8/1989 | European Pat. Off. . | |
| 3220279 | 12/1983 | Germany | 343/713 |
| 3521732 | 1/1986 | Germany . | |
| 61-210705 | 9/1986 | Japan . | |

OTHER PUBLICATIONS

Patent Abstracts Of Japan, vol. 11, No. 209 (E-521), Jul. 7, 1987, JP-A-62-030407, Feb. 9, 1987.

Patent Abstracts Of Japan, vol. 4, No. 97 (E-18)(579), Jul. 12, 1980, JP-A-55-60304, May 7, 1980.

*Primary Examiner*—Donald T. Hajec

*Assistant Examiner*—Tan Ho

*Attorney, Agent, or Firm*—Oblon, Spivak, McClelland, Maier & Neustadt, P.C.

[57] ABSTRACT

A diversity glass antenna for an automobile, wherein a dipole antenna is provided on a glass plate of a window of an automobile, a single pole antenna is provided at a part other than the glass plate and a stronger one of receiving signals of the dipole antenna and the single pole antenna is selected and employed, or, a diversity glass antenna for an automobile, wherein a single pole antenna is provided on a glass plate of a window of an automobile, a dipole antenna is provided at a part other than the glass plate and a stronger one of receiving signals of the dipole antenna and the single pole antenna is selected and employed.

8 Claims, 11 Drawing Sheets

FIGURE 3a
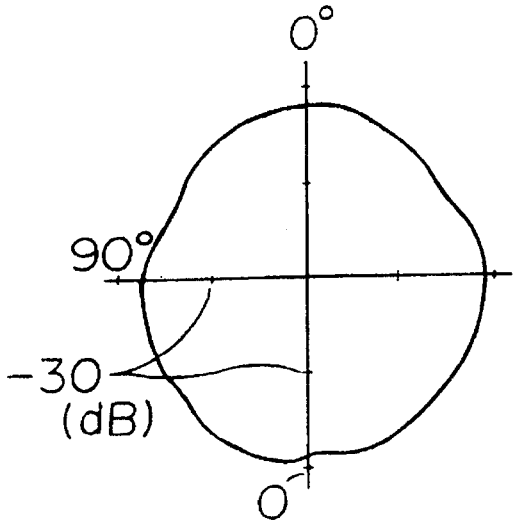
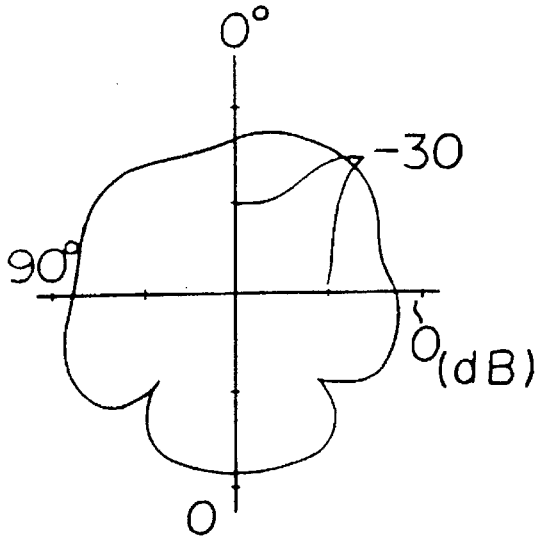
FIGURE 3b
FIGURE 4a
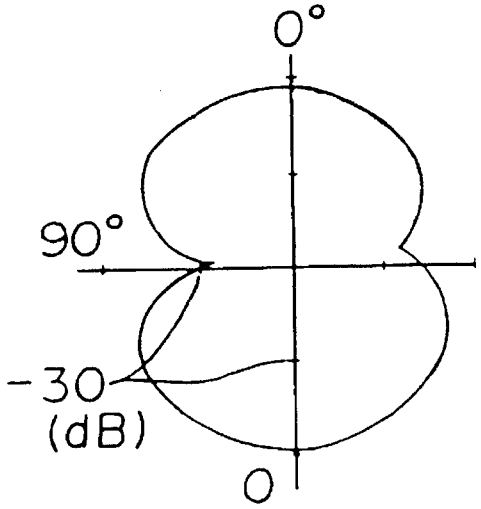
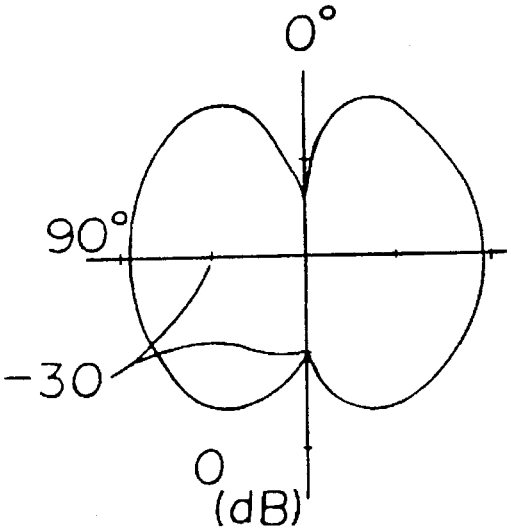
FIGURE 4b

FIGURE 7a
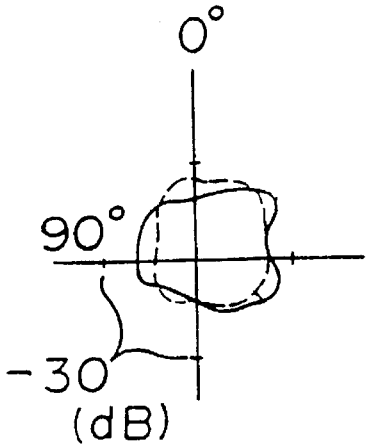
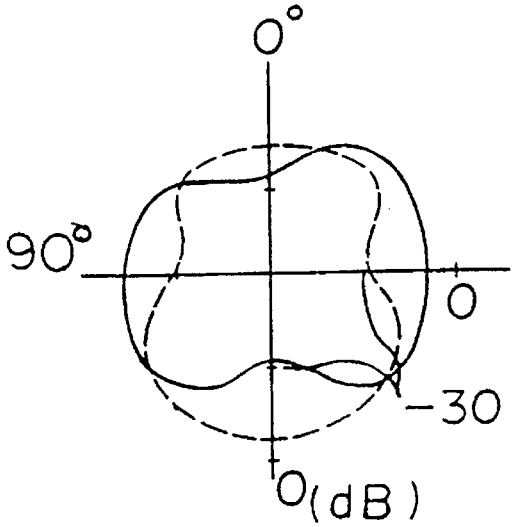
FIGURE 7b
FIGURE 8a
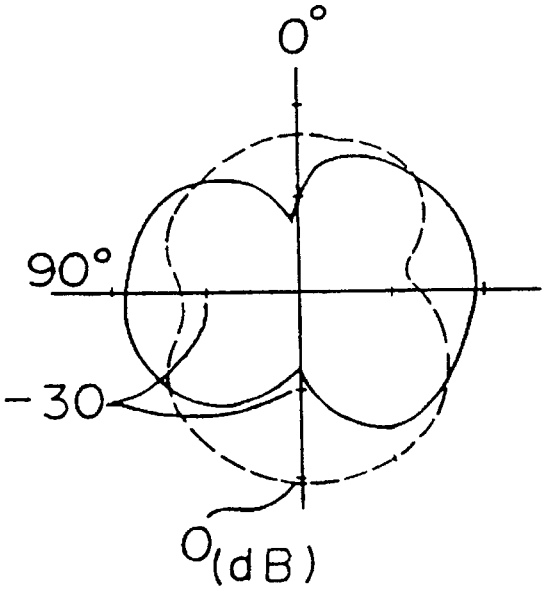
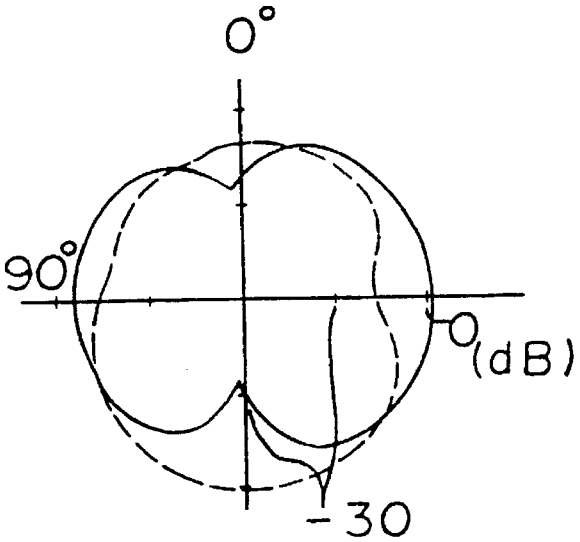
FIGURE 8b FIGURE 9a
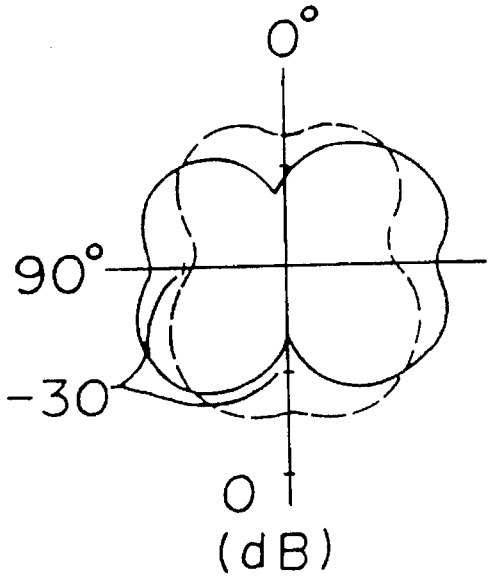
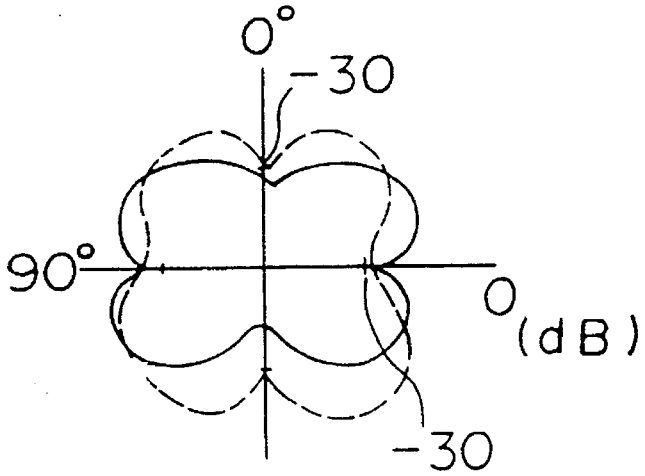
FIGURE 9b
FIGURE 10
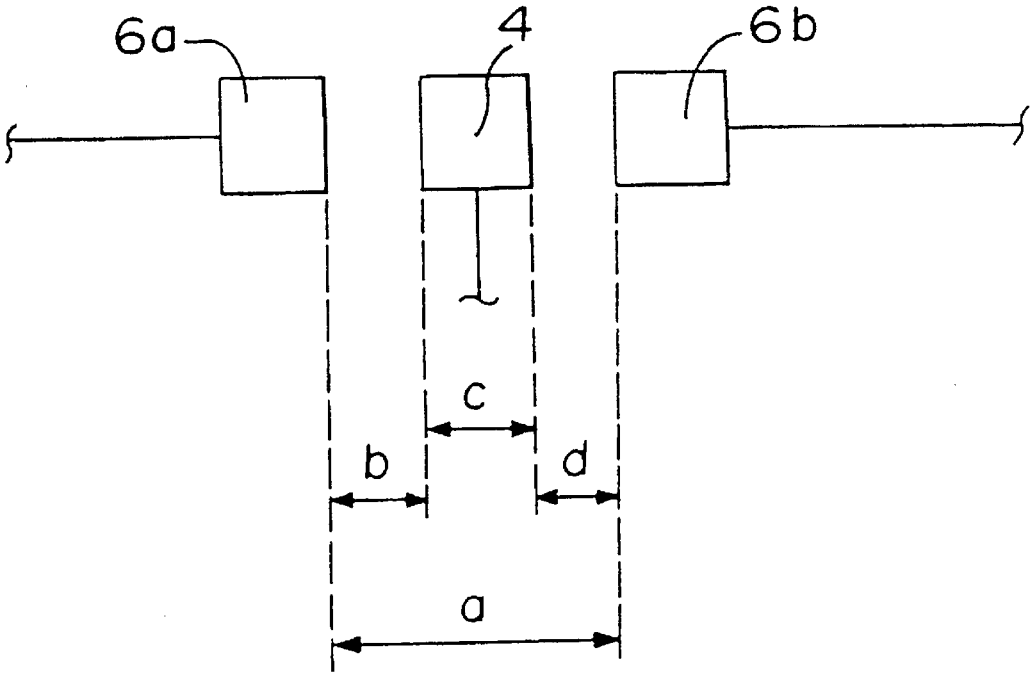

DIVERSITY GLASS ANTENNA FOR AN AUTOMOBILE

This application is a continuation of application Ser. No. 08/038,258, filed on Mar. 24, 1993, now abandoned.

BACKGROUND OF THE INVENTION

1. Field of the Invention

This invention relates to a diversity glass antenna for an automobile which is suitable for receiving a radiowave of approximately 30 MHz through 3 GHz.

2. Description of the Prior Art

As shown in FIG. 24, conventionally, a glass antenna is mounted on an automobile on sale and is publicly known, wherein a main antenna 31 and a subantenna 32 are provided on the upper portion and the lower portion of a glass plate 1 in a rear window of an automobile, interposing a defogger composed of bus bars 5 and a plurality of heater lines 2. In this case, to perform diversity receiving, receiving signals of the main antenna 31 and the sub antenna 32 are inputted into a selecting circuit 11 and a stronger one of the receiving signals is selected and transmitted to a receiver.

However, in the conventional example, since the main antenna 31 and the sub antenna 32 are single pole antennas, that is, antennas each of which employs a potential difference between a single power feeding point and the ground as the receiving signal, the directivity characteristics of both are similar. As a result, it is possible to adjust the antennas to be omni-directional with respect to a polarization plane in a specific direction. However, it is not possible to adjust the antenna to be omni-directional with respect to all the polarization planes and the diversity effect can not be provided.

Furthermore, when the receiving is performed by a single omni-directional antenna, irrespective of a pole antenna or a glass antenna, a multiple path strain is generated by simultaneously receiving the original radiowave and a reflecting wave from a building or the like and the receiving sound quality is deteriorated.

SUMMARY OF THE INVENTION

It is an object of the present invention to solve the above drawbacks of the conventional technology and to newly provide a diversity glass antenna for an automobile which has not conventionally known.

According to an aspect of the present invention, there is provided a diversity glass antenna for an automobile, wherein a dipole antenna is provided on a glass plate of a window of an automobile, a single pole antenna is provided at a part other than the glass plate and a stronger one of receiving signals of the dipole antenna and the single pole antenna is selected and employed.

According to another aspect of the present invention, there is provided a diversity glass antenna for an automobile, wherein a single pole antenna is provided on a glass plate of a window of an automobile, a dipole antenna is provided at a part other than the glass plate and a stronger one of receiving signals of the dipole antenna and the single pole antenna is selected and employed.

According to another aspect of the present invention, there is provided a diversity glass antenna for an automobile, wherein one or a plurality of single pole antennas and one or a plurality of dipole antennas are provided on a glass plate or glass plates of an automobile and the strongest one of receiving signals of the single plate antennas and the dipole antennas is selected and employed.

BRIEF DESCRIPTION OF THE DRAWINGS

In the drawings:

FIG. 3(*a–b*) illustrate directivity characteristic diagrams of a pole antenna 13 of FIG. 1 in the vicinity of 30 MHz through 108 MHz;

FIG. 4(*a–b*) illustrate directivity characteristic diagrams of a dipole antenna 16 or 26 of FIG. 2 in the vicinity of 30 MHz through 108 MHz;

FIG. 7(*a–b*) illustrate directivity characteristic diagrams of a dipole antenna 6 in FIG. 1 in the vicinity of 30 MHz through 108 MHz;

FIG. 8(*a–b*) illustrate directivity characteristic diagrams of the dipole antenna 6 in FIG. 1 in the vicinity of 30 MHz through 108 MHz;

FIG. 9(*a–b*) illustrate directivity characteristic diagrams of the dipole antenna 6 in FIG. 1 in the vicinity of 30 MHz through 108 MHz;

FIG. 10 is an enlarged front diagram of the dipole antenna 6 in FIG. 1 in the vicinity of power feeding points;

DESCRIPTION OF THE PREFERRED EMBODIMENTS

The present invention intends to improve the directivity characteristic of polarization planes in all the directions employing a difference in the directionality characteristic of receiving sensitivity (hereinafter, simply directionally characteristic) mainly in the vertical plane of polarization or the horizontal plane of polarization of a single pole antenna and a dipole antenna. Furthermore, at least one of a plurality of antennas is a glass antenna. Therefore, the diversity receiving can be constructed compactly as well as with the improvement of the directionality characteristic.

In the specification, the single pole antenna is an antenna having a single power feeding point and normally employing a potential difference between the power feeding point and the ground as a receiving signal. Furthermore, the dipole antenna is an antenna having two power feeding points and employing a potential difference between the power feeding points as a receiving signal.

This invention is suitable for receiving a radiowave of approximately 30 MHz through 3 GHz. This is because this range is normally suitable for receiving by the glass antenna.

In the present invention, when the dipole antenna and the two power feeding points of the dipole antenna are provided on the glass plate of a window of an automobile, a distance between the two power feeding points is an important factor for obtaining the omni-directionality in performing the diversity receiving.

An explanation will be given of a diversity glass antenna shown in FIG. 1, as an example.

The distance a between the power feeding points 6*a* and 6*b* of the dipole antenna 6 has an important influence on the directionality characteristic of the dipole antenna 6.

The distance a is preferable to be in a range of 1 mm through 65 mm. This is because the range can clearly differentiate the directionality characteristic of the dipole antenna from that of the single pole antenna.

Figure 1:
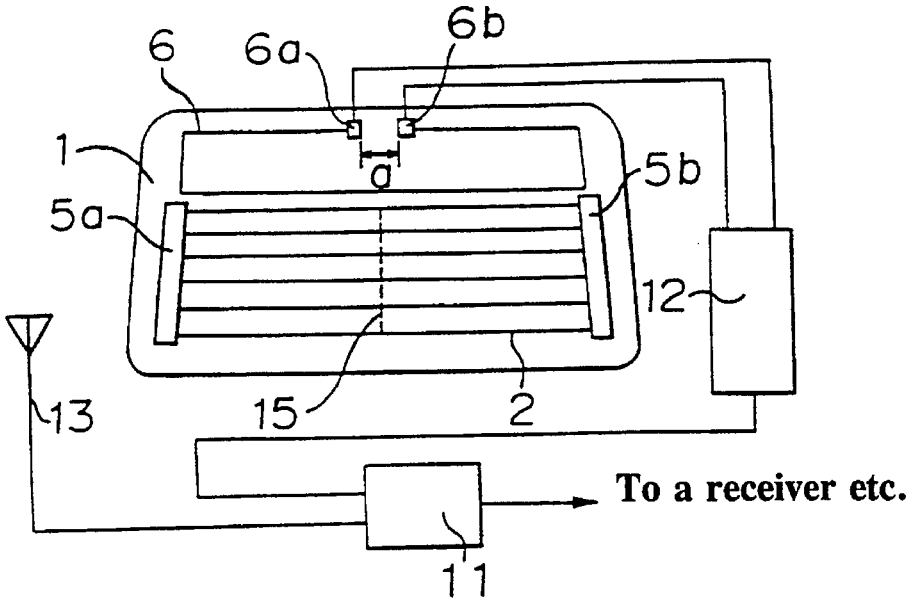
FIG. 1 is a construction diagram showing Example 1.

For instance, in FIG. 1, when a width (in the horizontal direction of FIG. 1) of the dipole antenna 6 is determined to be 1100 mm and a longitudinal dimension (in the vertical direction of FIG. 1), 200 mm, and when the distance a is changed, the directionality characteristic in the vicinity of 30 MHz through 108 MHz including a FM broadcast frequency band, is as shown in FIG. 7(*a*) through FIG. 9(*b*). Furthermore, all the directionality characteristic diagrams in the present invention are for the frequency band of 30 MHz through 108 MHz and the unit is dB, which is shown by a difference of receiving sensitivity (dipole ratio) when a receiving sensitivity of a standard dipole antenna is determined to be 0 dB.

FIG. 7(*a*) designates a directionality characteristic diagram for the case of the distance a of 0.5 mm, FIG. 7(*b*), for the case of the distance a of 2 mm, FIG. 8(*a*), for the case of the distance a of 15 mm, FIG. 8(*b*), for the case of the distance a of 25 mm, FIG. 9(*a*), for the case of the distance a of 45 mm and FIG. 9(*b*), for the case of the distance a of 70 mm. Furthermore, this tendency continues up to the vicinity of 800 MHz, even when the frequency is equal to or more than 108 MHz.

Figure 5:
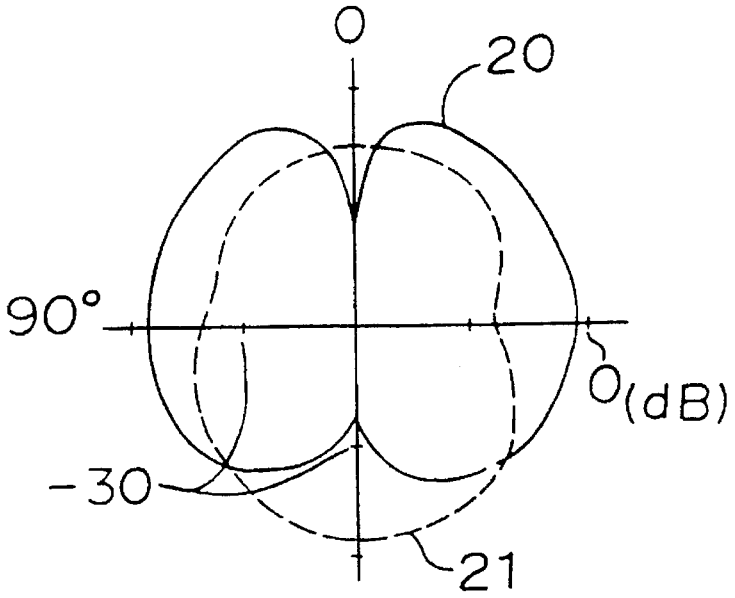
FIG. 5 is a directivity characteristic diagrams of a horizontal plane of polarization of a single pole antenna or a dipole antenna of Example 3 in the vicinity of 30 MHz through 108 MHz.

When the distance a is under 1 mm (FIG. 7(*a*)), the both power feeding points 6*a* and 6*b* are in a capacitive coupling and a sufficient receiving sensitivity can not be provided. When the distance a exceeds 65 mm (FIG. 9(*b*)), the receiving sensitivities in the horizontal plane of polarization in the direction of 0° (in the front direction of an automobile) and in the direction of 180° (in the rear direction of an automobile) are deteriorated, which can not compensate for insufficient portions of the receiving sensitivity in the direction of 0° and in the direction of 180° of the single pole antenna (FIG. 5). A more preferable range of the distance a is 10 mm through 45 mm.

It is generally common to the dipole antenna provided on the glass plate irrespective of any shape thereof, that the range of 1 mm through 65 mm is preferable as the range of the distance a.

Furthermore, as shown in FIG. 10, when a power feeding point 4 of the single pole antenna is provided between the power feeding points 6*a* and 6*b* of the dipole antenna provided on the glass plate, the following range is preferable in the receiving characteristic.

$$\text{Distance } a = (\text{distance } c + 4 \text{ mm}) \sim 80 \text{ mm}$$

where "c" designates a width of the power feeding point 4 and $b \geqq 2$ mm, $d \geqq 2$ mm.

The above relationship is provided for the same reason as in the case wherein the power feeding point of the single pole antenna is not provided between the power feeding points of the dipole antenna.

When the distance a is under (distance c+4 mm), the sufficient sensitivity can not be provided and the receiving sensitivities of the horizontal plane of polarization in the direction of 0° and in the direction of 180° are deteriorated. Furthermore, when the distance a exceeds 80 mm (and $b \geqq 2$ mm, $d \geqq 2$ mm), the receiving sensitivities of the horizontal plane of polarization in the direction of 0° and in the direction of 180° are similarly deteriorated, which can not compensate for the receiving sensitivity of the single pole antenna. A more preferable range of the distance a is (distance c+14 mm)~60 mm.

When the single pole antenna and the dipole antenna are provided on the glass plate of a window of an automobile, it is preferable in view of a wiring transmitting the receiving signal to a selecting circuit or the like, to provide the power feeding point of the single pole antenna in the vicinity of the power feeding points of the dipole antenna. This is because the productivity is promoted and the S/N ratio and the like are also promoted. The distance between the power feeding point of the single pole antenna and the power feeding points of the dipole antenna is preferably not larger than 200 mm, more preferably, not more than 100 mm.

An explanation will be given of embodiments in details in accordance with the drawings, as follows.

EXAMPLE 1

FIG. 1 shows a basic construction of a diversity glass antenna of Example 1.

In FIG. 1, a reference numeral 1 designates a glass plate of a rear window of an automobile, 2, a heater line, 5*a* and 5*b*, bus bars, and 6*a* and 6*b*, power feeding points of the dipole antenna 6 provided on the glass plate 1.

Furthermore, a numeral 12 designates a matching circuit composed of a matching transformer, an electronic circuit and the like, 13, a pole antenna which is a single pole antenna mounted on a car body of an automobile, 11, a selecting circuit and 15, a shorting line which is provided in accordance with the necessity.

The dipole antenna 6, the feeding points 6*a* and 6*b* and the like are formed by printing silver paste on the glass 1 and curing it.

The diversity glass antenna of Example 1 is constructed as above. The receiving signal generated between the power feeding points 6*a* and 6*b* of the dipole antenna 6, is transmitted to the selecting circuit 11 through the matching circuit 12 having such a function as performing impedance matching thereof with a next stage of the selecting circuit 11 and the like.

Furthermore, the matching circuit 12 may be included in the selecting circuit 11.

The receiving signal of the pole antenna 13 is transmitted to the selecting circuit 11. The selecting circuit 11 transmits a stronger one of the receiving signals of the dipole antenna 6 and the pole antenna 13 to a receiver or the like.

In Example 1, the pole antenna 13 having a full length of 900 mm is employed. The directionality characteristic diagram of the horizontal plane of polarization of the pole antenna 13 is shown in FIG. 3(*a*), and the directionality characteristic diagram of the vertical plane of polarization, FIG. 3(*b*), respectively.

Furthermore, the directionality characteristic diagram of the dipole antenna 6 is shown in FIG. 8(*b*). The distance a between the power feeding points 6*a* and 6*b* in FIG. 1 is 25 mm. The relationship between the distance a and the dipole antenna is as stated above.

In Example 1, since the strongest receiving signal is employed among the directionality characteristics of the respective antennas shown in FIGS. 3(*a–b*) and 4(*a–b*), an approximately uniform directionality characteristic is shown with respect to the polarization planes in all the directions.

Figure 11:
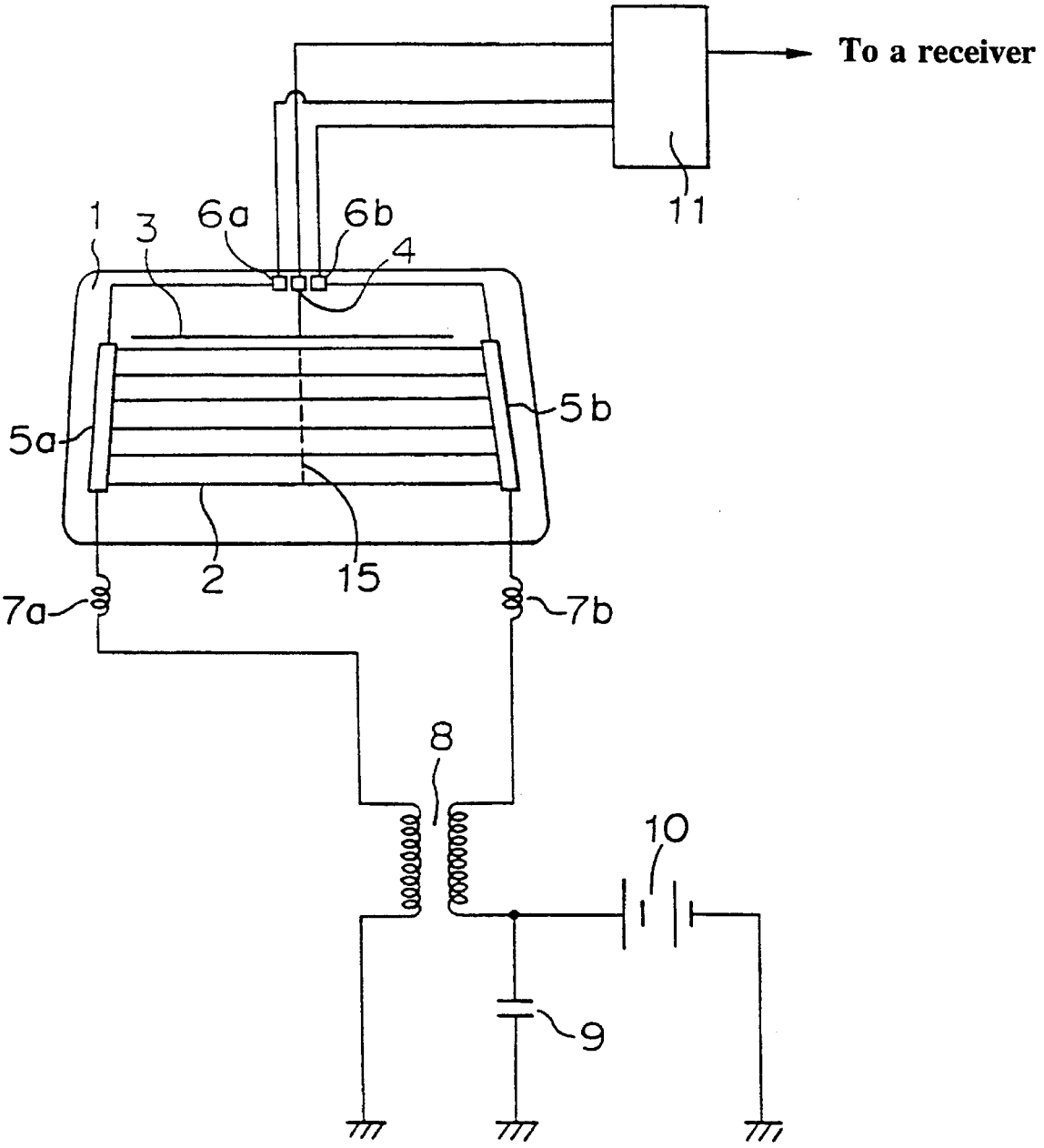
FIG. 11 is a construction diagram showing Example 3.

Furthermore, in Example 1, the shorting line 15 is not provided. When approximately central portions of the respective heater lines are shortcircuited by the shorting line 15, in case wherein the heater line 2 and the dipole antenna 6 are in a capacitive coupling, the defogger functions as an antenna, and therefore, the receiving sensitivity is promoted by several dBs. In this case, the defogger is insulated from the car body (ground) with respect to a high frequency by the choke coil. The wiring and the like are shown in Example 3 (FIG. 11). Also in the other Examples, when the defogger is employed as an antenna by the capacitive coupling, the wiring of FIG. 11 is utilized.

The effect of the shorting line 15 is created similarly in the following examples and a detailed explanation will be given to the following Example 4.

EXAMPLE 2

Figure 2:
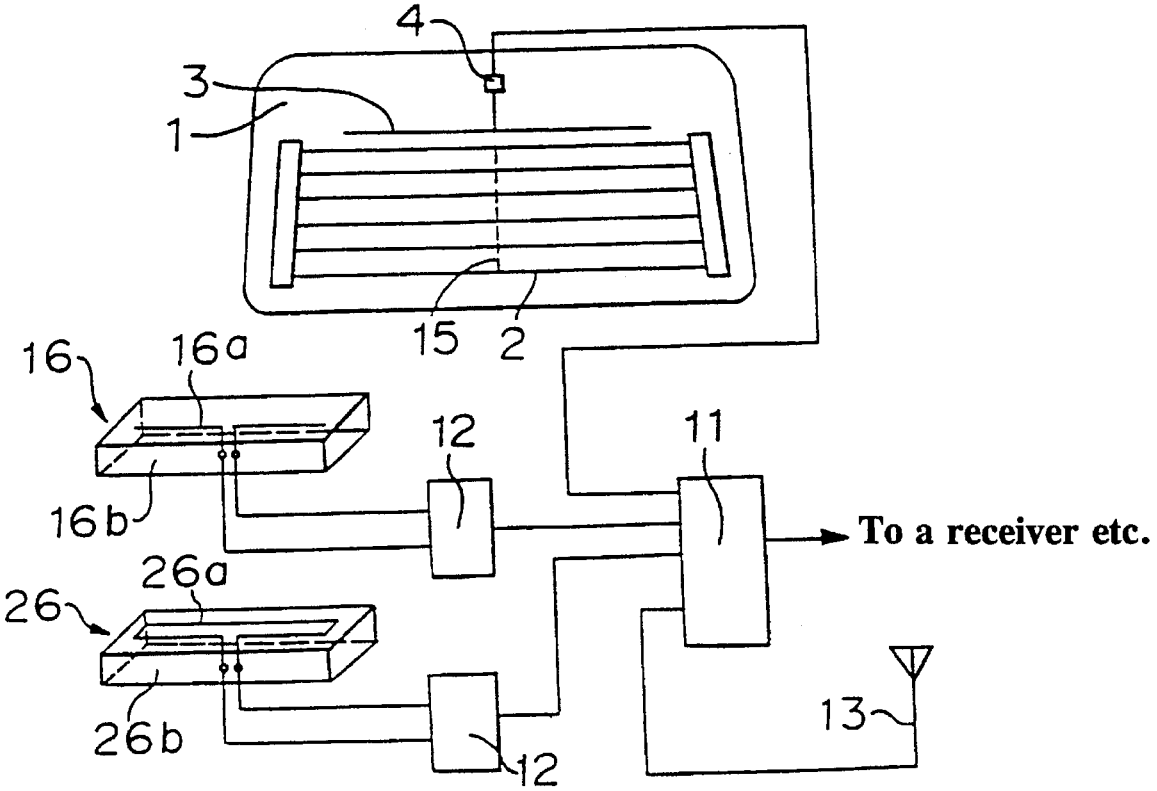
FIG. 2 is a construction diagram showing Example 2.

Example 2 shown in FIG. 2 is a diversity glass antenna having a type different from that in Example 1.

In FIG. 2, a notation the same with that in FIG. 1 is employed for the part having a reference name the same with that in FIG. 1, which is applied in the following respective diagrams. The portion attached with the same notation in the respective diagram is provided with the same reference name.

Furthermore, in FIG. 2, a reference numeral 3 designates a single pole antenna provided on the glass plate 1 of a rear window, 4, a power feeding point of the single pole antenna 3, 16, a dipole antenna composed of an antenna conductor 16*a* consisted of metal lines and a resin case 16*b*, and 26, a dipole antenna composed of an antenna conductor 26*a* consisted of metal lines and a resin case 26*b*.

The pole antenna 13 is mounted on a portion of the car body, the dipole antenna 16, on the roof of an automobile and the dipole antenna 26, on a lid of a rear trunk.

The widths (in the horizontal direction of FIG. 2) of both of the antenna conductors 16*a* and 26*a* are 1.6 m. The directivity characteristics of the dipole antennas 16 and 26 are almost the same which are shown in FIG. 4. Furthermore, the directionality characteristic of the single pole antenna 3 is almost the same with the directionality characteristic diagrams (FIGS. 5 and 6) of the single pole antenna 3 in Example 3 to be mentioned later. FIG. 5 is for the horizontal plane of polarization and FIG. 6, for the vertical plane of polarization.

When the strongest one of the four receiving signals of the single pole antenna 3, the pole antenna 13 and the dipole antennas 16 and 26, is selected by the selecting circuit and is transmitted to a receiver, an approximately uniform directionality characteristic is provided with respect to all the polarization planes.

EXAMPLE 3

FIG. 11 shows a basic construction of a diversity glass antenna of Example 3. In FIG. 11, notations 7*a* and 7*b* designate coils for high frequency wave, 8, a choke coil, 9, a condenser, and 10, a battery. Furthermore, in Example 3, the shorting line 15 is not provided.

In Example 3, the defogger composed of bus bars 5*a* and 5*b* and a plurality of heater lines 2 is to be employed as a dipole antenna.

Furthermore, in Example 3, the single pole antenna 3 is disposed in the vicinity of the uppermost heater line 2. The single pole antenna 3 is not connected to the heater line 2 with respect to a direct current. However, with respect to a high frequency wave, the single pole antenna 3 is connected to the uppermost heater line 2 in the capacitive coupling. This is because the defogger is intended to be employed as an antenna and the receiving sensitivity is intended to be promoted by several dBs or more. Furthermore, it is not always necessary to produce the capacitive coupling. Whether the capacitive coupling is performed, is suitably determined in accordance with the necessity.

The defogger functions as a dipole antenna. This is because the defogger is provided with the width in the horizontal direction necessary for utilizing the defogger as an antenna and the power feeding is performed from both sides of the defogger. The potential difference generated between the power feeding points 6*a* and 6*b* caused by receiving signals is employed as the receiving signal. The antenna line respectively connecting the power feeding points 6*a* and 6*b* and the bus bars 5*a* and 5*b* may not be extended from the bus bars 5*a* and 5*b* as shown in FIG. 1 and may be extended from the uppermost portion or the lowermost portions of the heater lines 2 in the vicinity of the bus bars 5*a* and 5*b*.

A current from the battery 10 passes through the choke coil 8 and is transmitted to the defogger through high frequency wave coils 7*a* and 7*b*, wherein the defogging is performed.

The choke coil 8 is provided with a function of insulating the defogger from the ground in the broadcast frequency band. The high frequency wave coils 7*a* and 7*b* are inserted in accordance with the necessity to compensate for a deteriorated characteristic of the choke coil 8 in the high frequency wave range (not smaller than 30 MHz).

The condenser 9 is provided with a function of preventing noise and the like.

The selecting circuit 11 selects a stronger one of the receiving signal from the single pole antenna 3 and the receiving signal from the defogger and sent it to a receiver.

Figure 6:
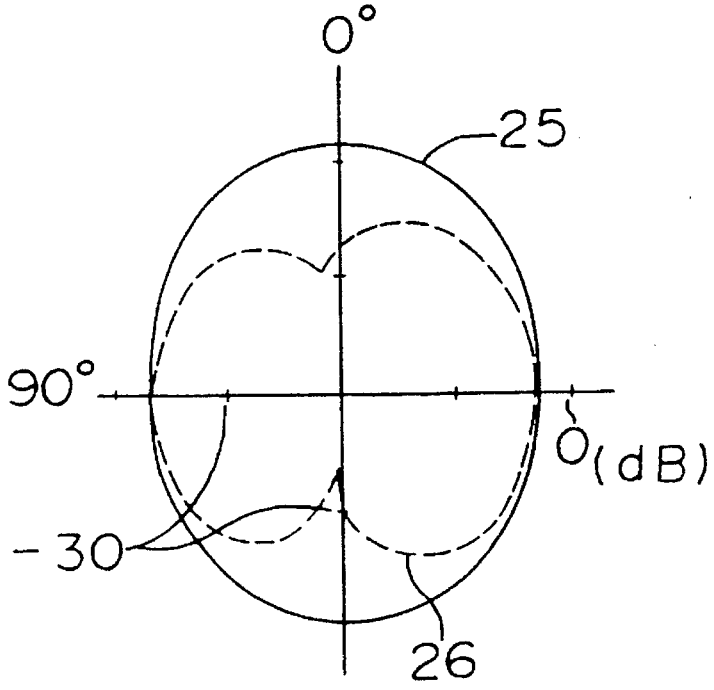
FIG. 6 is a directivity characteristic diagrams of a vertical plane of polarization of the single pole antenna or the dipole antenna of Example 3 in the vicinity of 30 MHz through 108 MHz.

The directionality characteristics of the respective antennas in Example 3 in a range of 30 MHz through 108 MHz are approximately as in FIGS. 5 and 6. FIG. 5 is for a horizontal plane of polarization and FIG. 6, for the vertical plane of polarization. In FIGS. 5 and 6, 0° designates arrival of a radiowave from the front direction of an automobile and 90°, that from the left side direction thereof. Furthermore, numerals 20 and 25 designate the directivity characteristics of the single pole antenna 3, and 21 and 26, those in case wherein the defogger is employed as an antenna, that is, the directionality characteristics of the dipole antenna.

In Example 3, since the stronger one of the receiving signals from the single pole antenna 3 and the defogger, is selected and employed, the diversity receiving effect having an approximately uniform directionality characteristic with respect to all the polarization planes as well as the horizontal and the vertical planes of polarization, can be provided. Furthermore, almost no multiple pass strain is generated. Specifically, when only the single pole antenna 3 of FIG. 11 is employed, a difference between the maximum value and the minimum value of the directionality characteristic in the horizontal plane of polarization, is approximately 30 dB. However, in Example 3, the difference is not more than 10 dB.

EXAMPLE 4

The shorting line 15 is provided in approximately vertical direction at approximately central portions of the respective heater lines 2 in FIG. 11, thereby shortcircuiting the respective heater lines 2. This is because the impedance of the defogger which is employed as an antenna, does not show a constant change in accordance with the frequency even under a constant environment, and shows unstable changes. Therefore, mismatching of impedance is generated between the defogger and a transmitting cable having an impedance of generally 50Ω, 75Ω or the like. The receiving sensitivity is dependent on the frequency and a constant receiving sensitivity can not be provided.

However, although the cause is not clear, it is revealed that the impedance of the defogger shows a constant change in accordance with the change of the frequency, when points having the same potential of the respective heater lines 2 are connected by the shorting line 15.

This example is tested under the construction similar to that in Example 3 except the defogger having the shorting line 15 is employed as the dipole antenna. As a result, a difference between the maximum value and the minimum value of the receiving sensitivity with respect to the frequency, of the dipole antenna in Example 3 is approximately 10 dB in the range of 30 MHz through 108 MHz. In Example 4, the difference is reduced to approximately 5 dB.

Furthermore, in Example 4, only a single line of the shorting line 15 is provided at the central portions. However, the providing position and the number of the shoring lines are not limited to this Example and are pertinently determined in accordance with the shape of the defogger, which is applicable to the other Examples.

EXAMPLE 5

FIGS. 12 through 19 designate variation examples of antenna lines other than that in FIG. 11 of Example 3.

Figure 12:
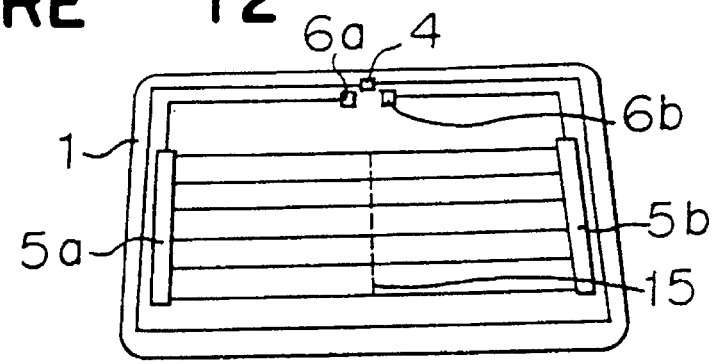
FIG. 12 is a front diagram of a variation example of an antenna line other than that in Example 3.

In case of FIG. 12, the defogger is a dipole antenna and an antenna line surrounding the defogger is a single pole antenna.

Figure 13:
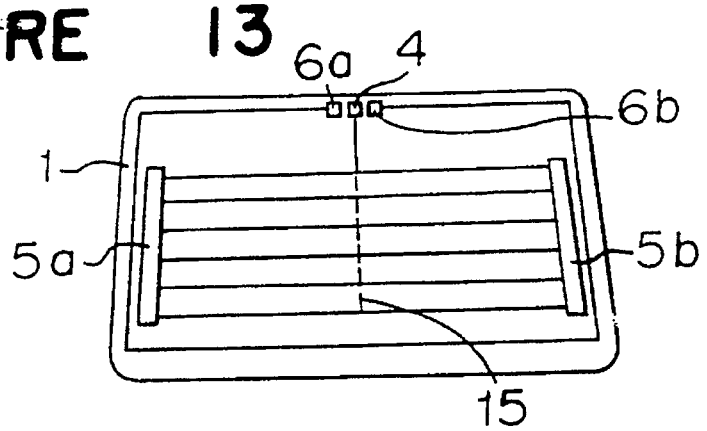
FIG. 13 is a front diagram of a variation example of an antenna line other than that in Example 3.
Figure 14:
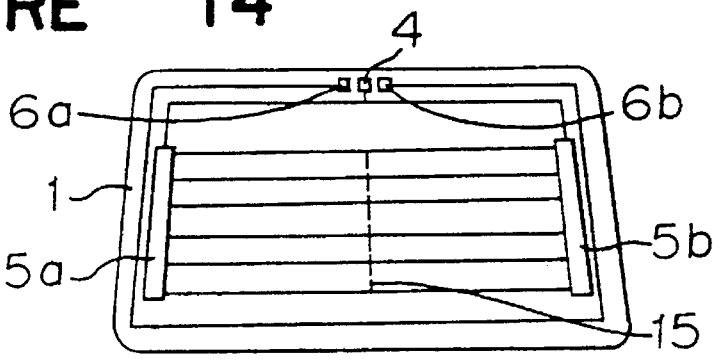
FIG. 14 is a front diagram of a variation example of an antenna line other than that in Example 3.

In cases of FIGS. 13 and 14, the defogger is a single pole antenna and an antenna line surrounding the defogger is a dipole antenna.

Figure 15:
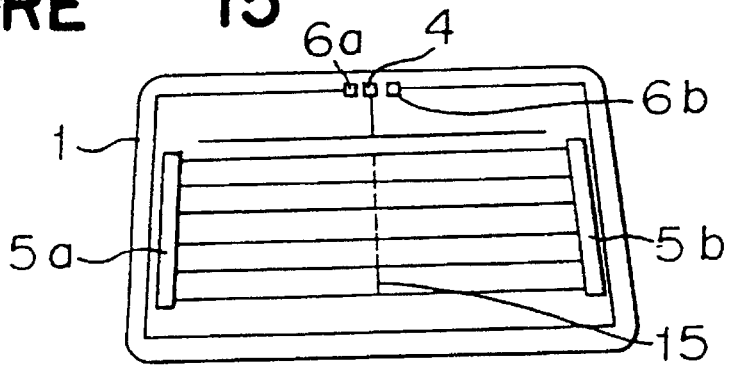
FIG. 15 is a front diagram of a variation example of an antenna line other than that in Example 3.

In case of FIG. 15, a single pole antenna and a dipole antenna are respectively provided around the defogger. The single pole antenna 3 is in a capacitive coupling with the uppermost portion of the heater line 2 in accordance with the necessity.

Figure 16:
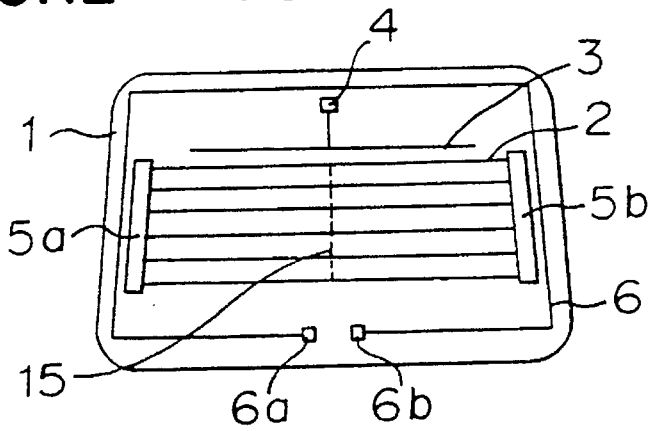
FIG. 16 is a front diagram of a variation example of an antenna line other than that in Example 3.

In case of FIG. 16, the dipole antenna 6 is provided in the vicinity of the peripheral edge of the glass plate 1 and the single pole antenna 3 and the defogger are provided inside the dipole antenna 6.

The single pole antenna 3 and the uppermost portion of the heat line 2 are in a capacitive coupling in accordance with the necessity.

Figure 17:
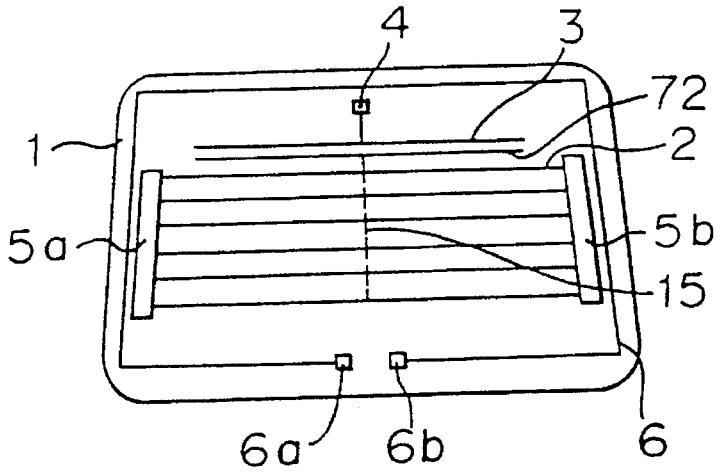
FIG. 17 is a front diagram of a variation example of an antenna line other than that in Example 3.

In case of FIG. 17, a T-shaped auxiliary antenna 72 is provided at the uppermost portion of the heater line 2 of the glass antenna shown in FIG. 16. By forming a capacitive coupling between the single pole antenna 3 and the T-shaped auxiliary antenna 72, the defogger composed of the bus bars **5*a* and 5*b* and the heater lines 2 is to be employed as a portion of the single pole antenna 3**.

Figure 18:
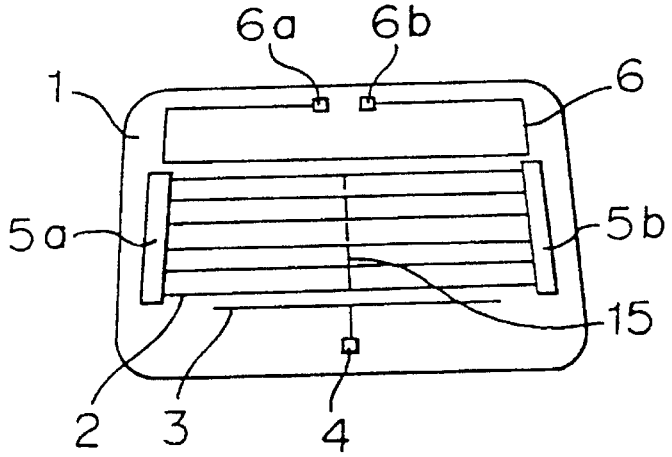
FIG. 18 is a front diagram of a variation example of an antenna line other than that in Example 3.

In the glass antenna shown in FIG. 18, the dipole antenna 6 is provided in the upper space of the defogger and the single pole antenna 3 is provided at the lower space thereof. The dipole antenna 6 or the single pole antenna 3 is in a capacitive coupling with the defogger in accordance with the necessity.

Figure 19:
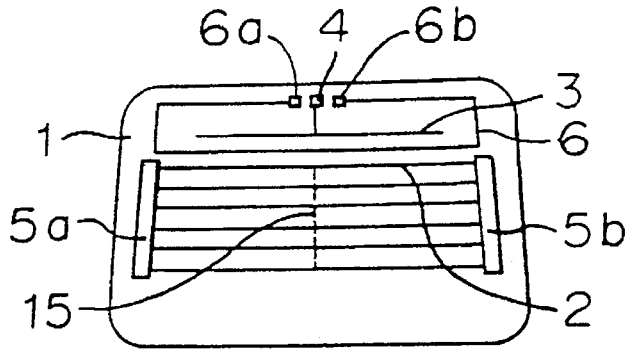
FIG. 19 is a front diagram of a variation example of an antenna line other than that in Example 3.

In the glass antenna shown in FIG. 19, the dipole antenna 6 is provided in the upper space of the defogger, and the single pole antenna 3 is provided inside the dipole antenna 6. The dipole antenna 6 and the uppermost portion of the heater line 2 is in a capacitive coupling in accordance with the necessity.

When the diversity receiving is performed by the antennas shown in FIGS. 12 through 19 under the construction the same with that in FIG. 11, as in the case of FIG. 11, the diversity receiving effect excellent in the directionality characteristic can be provided in the horizontal and the vertical planes of polarization.

EXAMPLE 6

Figure 20:
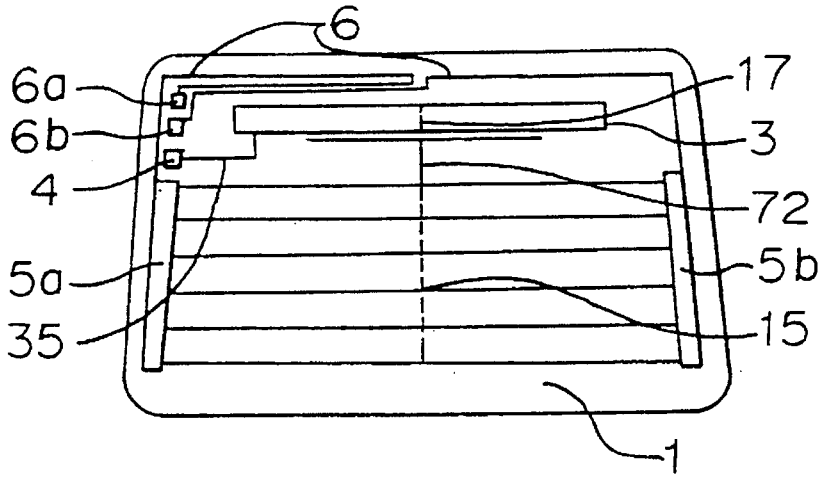
FIG. 20 is a front diagram of an antenna line in Example 6.

In Example 6 shown in FIG. 20, the power feeding points **6*a* and 6*b* of the dipole antenna 6 integrated with the bus bars and the power feeding point 4 of a loop-like single pole antenna 3 are provided at a side portion of the glass plate 1** of the rear window.

In view of the problems of wiring and the like, when the power feeding points **6*a* and 6*b* are provided at the side portion of the glass plate 1, an antenna line of the dipole antenna 6 is once extended from the power feeding point 6*a* to the central portion of the glass plate 1 and is turned back to connect to the bus bar 5*a***.

In this way, a length (Wa) of the antenna line between the power feeding point **6*a* to the bus bar 5*a* and a length (Wb) of the antenna line from the power feeding point 6*b* to the bus bar 5*b*** are almost equalized thereby providing a stable directionality characteristic by electrically taking a balance in the horizontal direction.

A difference between the length Wa and the length Wb is preferably within ±30% in view of the directionality characteristic.

Furthermore, a numeral 72 designates the T-shaped auxiliary antenna for the capacitive coupling between the defogger and the single pole antenna 3, which can be dispensed with. Furthermore, the reason why the single pole antenna 3 is in a loop-like form, is because the difference between the maximum value and the minimum value of the receiving sensitivity with respect to the frequency is reduced by several dBs, in the range of 30 MHz through 108 MHz, compared with the case wherein the single pole antenna 3 is not in the loop-like form. A numeral 17 designates an adjusting line of the impedance of the single pole antenna 3 for performing the impedance matching between the single pole antenna 3 and the next stage of a receiver or the like, which is provided in the vicinity of an approximately central portion of the loop-like antenna line of the single pole antenna 3 in accordance with the necessity.

The loop-like single pole antenna 3 or the adjusting line 17 is applicable to the other Examples.

Figure 21:
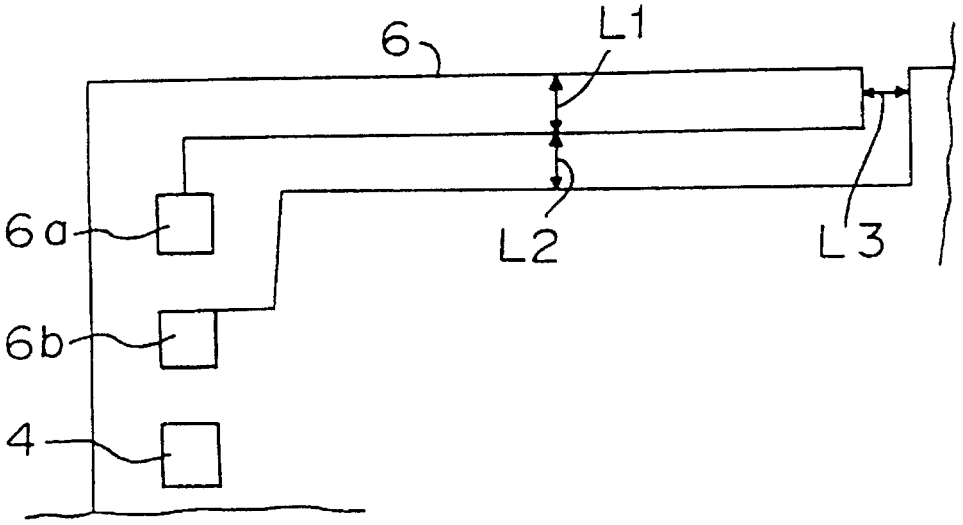
FIG. 21 is an enlarged front diagram of a dipole antenna 6 in Example 6 in the vicinity of power feeding points 6*a* and 6*b;*

FIG. 21 is an enlarged front diagram in the vicinity of the power feeding point 6*a* and 6*b* of the dipole antenna 6.

Ranges of the distances $L_1$, $L_2$ and $L_3$ between the respective antenna lines composing the dipole antenna 6 are preferable in a range of 1 mm through 65 mm.

The reason is the same with that of restricting the distance a between the power feeding point 6*a* and 6*b* of the dipole antenna shown in FIG. 1. When these distances are out of the above range, the receiving sensitivities in the front direction and in the rear direction of an automobile in the horizontal plane of polarization, are deteriorated. A more preferable range for the distances $L_1$, $L_2$ and $L_3$ is 10 mm through 45 mm.

Furthermore, a numeral 35 designates a connecting line for connecting the single pole antenna 3 and the power feeding point 4, which is provided with the function of phase adjustment of the single pole antenna 3.

Figure 22:
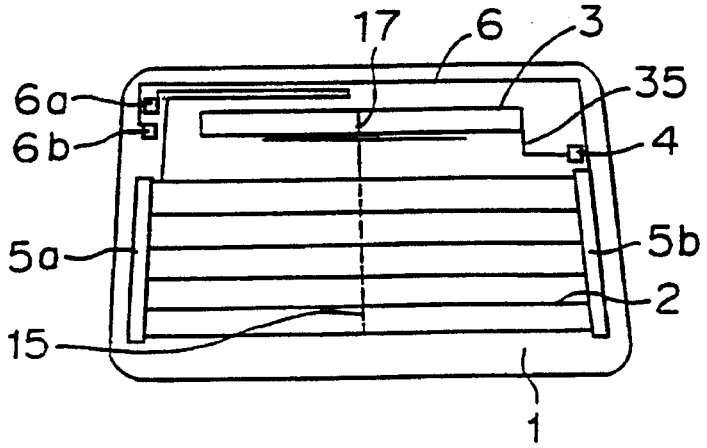
FIG. 22 is a front diagram of a variation example of an antenna line other than that in Example 6.

FIG. 22 is a variation example of the glass antenna of FIG. 20.

In FIG. 22, an antenna line of the dipole antenna 6 which is extended and connected from the power feeding point 6*a* to the bus bar 5*a*, is provided inside an antenna line of the dipole antenna 6 which is extended and connected from the power feeding point 6*b* to the bus bar 5*b*.

EXAMPLE 7

Figure 23:
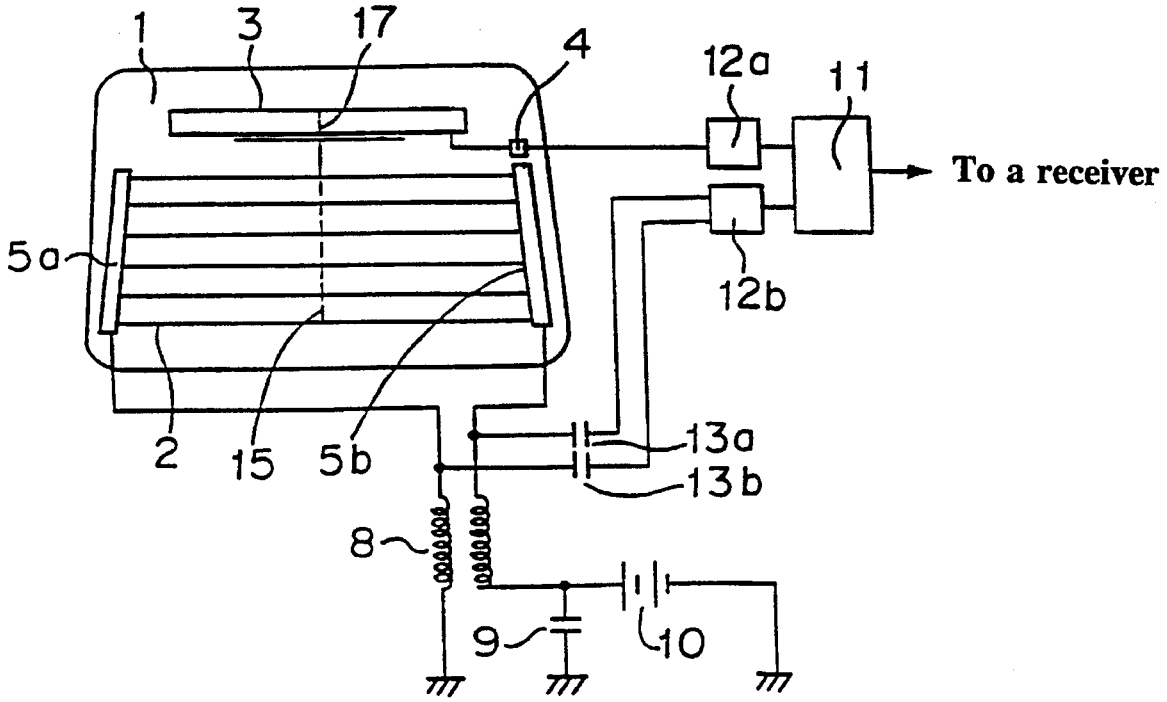
FIG. 23 is a front diagram of an antenna line in Example 7.
Figure 24:
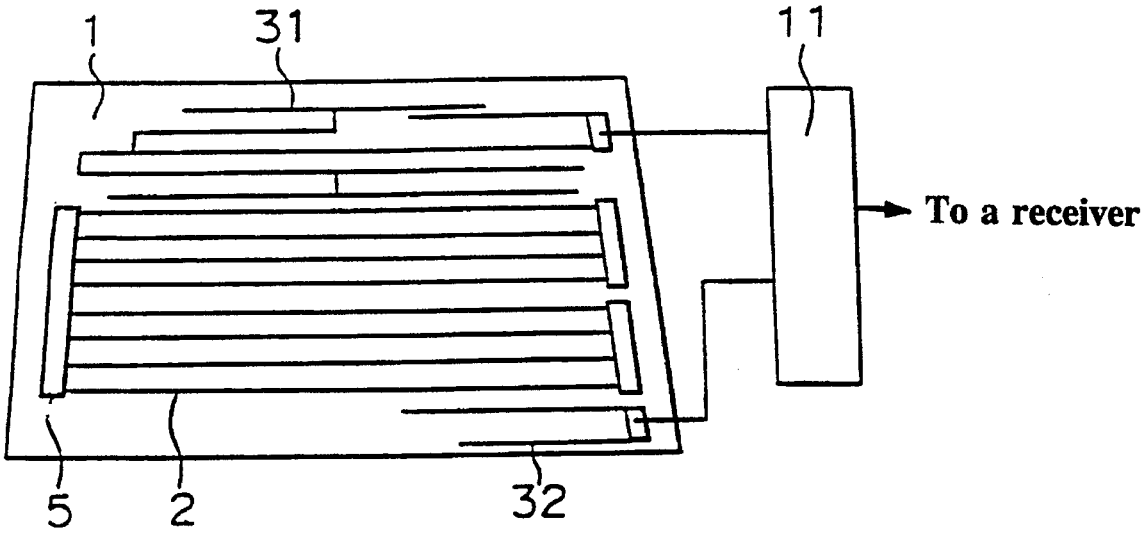
FIGURE 24 PRIOR ART
FIG. 24 is a front diagram of an antenna line of a conventional diversity glass antenna.

FIG. 23 shows the construction of Example 7. In Example 7, lines are shunted from connecting lines connecting the bus bars 5*a* and 5*b* and the choke coils 8 and the potential difference between the lines are employed as the receiving signal of the dipole antenna.

In FIG. 23, notations 12*a* and 12*b* designate matching circuits. Furthermore, notations 13*a* and 13*b* designate condensers for preventing a direct current which are provided in accordance with the necessity, and which prevent a surge voltage to be transmitted to the matching circuit 12*b* when the surge voltage is generated in the defogger, thereby preventing the matching circuit 12*b* to be destructed or the like.

When an experiment is performed in the construction of Example 7, an antenna function can be provided which is almost omni-directional with respect to all the polarization planes. Furthermore, in the above Examples 1 through 7, the glass antenna is provided on the glass plate of the rear window. However, the diversity receiving may be performed by disposing the single pole antenna and the dipole antenna in combination or separately on the respective glass plates or the like of a front window, a side window, a rear window, a sun roof and the like.

Furthermore, a diversity antenna may be constructed by at least one of the single pole antenna and the dipole antenna provided on the rear window, the side window and the like, and by at least one of the single pole antenna and the dipole antenna provided at other parts. A diversity receiving may be performed by combining the dipole antenna and the like shunted from the middle of the wirings between the bus bars 5*a* and 5*b* and the choke coils 8 of Example 7 and at least one of the single pole antenna and the dipole antenna provided at other part.

The present invention can provide the receiving characteristic of omni-directionality, since the single pole antenna and the dipole antenna having different directionality characteristics in the same polarization plane, are employed and the stronger one of the respective receiving signals of both, is selected and employed.

Furthermore, since the antennas having the directionalities are selectively employed, compared with the case wherein a single omni-directional antenna is employed, the possibility of simultaneous receiving of the reflecting wave of a building or the like and the original radiowave having a phase difference, is small and the multiple path strain caused by the simultaneous receiving is attenuated.

Furthermore, in case of employing the defogger as an antenna and shortcircuiting the vicinity of the approximately central portions of the respective heater lines by the shorting line 15, since the impedance of the defogger is stabilized, an approximately uniform receiving sensitivity can be provided even when the frequency is changed.

What is claimed is:

1. A diversity glass antenna for an automobile comprising:

a single pole antenna position within a window of the automobile;

a dipole antenna position within the window, which is arranged as a loop-like form having an opening to surround the single pole antenna wherein the single pole antenna has a feed point and the dipole antenna has a pair of feed points;

a defogger positioned in the window and having bus bars and heater lines functioning as the dipole antenna, and a choke coil connected between the defogger and a ground potential, wherein two feed points connected to the defogger are provided at a side portion of the window, a line connecting one of the feed points to one of the bus bars of the defogger is extended to a central portion of the window and is turned back to connect to the bus bar;

a selecting means for selecting a stronger signal received by the single pole antenna and the dipole antenna; and wherein, said diversity glass antenna generates an approximately uniform directionality characteristic in all polarization planes.

2. A diversity glass antenna for an automobile, comprising:

a dipole antenna positioned within a window of the automobile;

a single pole antenna positioned within the window, which is arranged as a loop like form to surround the dipole antenna wherein the single pole antenna has a feed point and the dipole antenna has a pair of feed points; and a selecting means for selecting a stronger signal received by the dipole antenna and the single pole antenna.

3. A diversity glass antenna according to claim 2, wherein a feed point is directly formed at a portion of the single pole antenna in a loop like form, and the feed point of the single pole antenna is arranged near the pair of feed points of the dipole antenna.

4. A diversity glass antenna according to claim 3, further comprising:

the single pole antenna capacitively coupled to the dipole antenna.

5. A diversity glass antenna according to claim 2, wherein the single pole antenna has a feed point positioned not more than 200 mm from the feed points of the dipole antenna.

6. A diversity glass antenna according to claim 2, further comprising a defogger positioned in the window and having bus bars and heater lines functioning as the dipole antenna, and a choke coil connected between the defogger and a ground potential.

7. A diversity glass antenna according to claim 6, wherein the single pole antenna is capacitively coupled to the dipole antenna.

8. A diversity glass antenna according to claim 6, further comprising:

a shorting line connecting a plurality of heating/antenna lines in a defogger such that a change of impedance of the dipole antenna is constant with respect to different frequencies.

* * * * *